US005746424A

United States Patent [19]

Rutten et al.

[11] Patent Number: 5,746,424

[45] Date of Patent: May 5, 1998

[54] DEVICE FOR COLLECTING FOLDED AND UNFOLDED COPY SHEETS

[75] Inventors: Hendrik Gerard Jozef Rutten, EK Arcen; Jacobus Arnoldus Peter Berkers, NP Koningslust; Gert Vegter, PT Baarlo, all of Netherlands

[73] Assignee: Oce-Nederland B.V., Venlo, Netherlands

[21] Appl. No.: 674,107

[22] Filed: Jul. 3, 1996

[30] Foreign Application Priority Data

Jul. 20, 1995 [NL] Netherlands ..... 1000855

[51] Int. Cl.[6] ..... B41L 43/12

[52] U.S. Cl. ..... 270/37; 271/303

[58] Field of Search ..... 270/37, 32; 271/303, 271/301

[56] References Cited

U.S. PATENT DOCUMENTS

| | | | |
|---|---|---|---|
| 4,441,704 | 4/1984 | Uchida et al. | 271/303 |
| 4,512,845 | 4/1985 | Kobler | 270/37 |
| 4,878,656 | 11/1989 | Honjo et al. | 270/37 |
| 5,263,706 | 11/1993 | Okada | 271/303 |
| 5,263,708 | 11/1993 | Hacknauer | 271/303 |
| 5,394,992 | 3/1995 | Winkler | 271/303 |

FOREIGN PATENT DOCUMENTS

| | | |
|---|---|---|
| 266739 | 11/1987 | European Pat. Off. . |
| 532069 | 3/1993 | European Pat. Off. . |
| 92/12087 | 7/1992 | WIPO . |

*Primary Examiner*—John T. Kwon

*Attorney, Agent, or Firm*—Birch, Stewart, Kolasch & Birch, LLP

[57] ABSTRACT

A device with a collecting station collects copy sheets which can be provided with a Z-fold in a folding station. The folding station is situated in a transport path for unfolded copy sheets which leads to the collecting station. The folding station is formed by a first pair of folding rollers, the folding nip of which is situated in the transport path, and a second pair of folding rollers, the folding nip of which is situated in a folding path branching off from the transport path. The direction of rotation of the folding rollers is reversible.

22 Claims, 3 Drawing Sheets

DEVICE FOR COLLECTING FOLDED AND UNFOLDED COPY SHEETS

FIELD OF THE INVENTION

The invention relates to a device for collecting a number of copy sheets into a straight stack in a collecting station. At least one of the sheets can be a folded copy sheet which in the folded state has a length dimension and a width dimension which are at maximum equal to the length and width dimensions of each unfolded copy sheet in the stack. The device has a first transport path for feeding copy sheets to the collecting station and at least one pair of first folding rollers forming a first folding nip.

DESCRIPTION OF THE INVENTION

A device of this kind is known from the PCT Patent Application WO 92/12087, which describes a device wherein the copy sheets for folding are led completely out of the transport path for copy sheets which do not require folding, and after they have been folded, they are returned to the transport path for copy sheets which do not require folding. In addition to transport paths running in parallel for copy sheets which do not require folding and those which do require folding, this known device requires a diverter for selectively feeding sheets to be folded to one transport path and sheets which do not require folding to the other transport path. This makes the device complex and bulky. Also, in this known device, a folded copy sheet is returned to the first transport path in a direction opposed to the direction in which a copy sheet not requiring folding moves. This requires a relatively long intermediate space for feeding a folded copy sheet between two unfolded copy sheets to the collecting station.

SUMMARY OF THE INVENTION

The object of the present invention is to provide a device which is simple and compact. This device will collect a number of copy sheets into a straight stack in a collecting station. At least one of the sheets can be a folded sheet with a maximum length and width equal to a length and width dimension of an unfolded sheet. A first transport path is provided for feeding copy sheets to the collecting station and at least one pair of feeding rollers is provided forming a first nip. The first folding nip is situated in the first transport path and a first transport nip is present in the first transport path for transporting a copy sheet to the first folding nip. A second transport path is present which adjoins that side of one of the first folding rollers which faces the first transport nip. The second transport path extends as far as the first transport path and is provided with a second transport nip with a reversible direction of transport.

As a result, a part of a copy sheet can be fed from the first transport path to the second transport path, whereupon, by reversal of the direction of transport of the second transport nip and transport of the rest of said copy sheet through the first transport nip, a fold can be formed in the first folding nip in the copy sheet between the said part and the remainder of the copy sheet. Thus, the first folding nip operates not only to transport a copy sheet not requiring folding through the first transport path to the collecting station, but also for folding and transporting a copy sheet in the one transport path to the collecting station.

In one attractive embodiment of a device according to the present invention, the first folding rollers are reversible in their direction of rotation and the second transport nip is a folding nip which is formed by a second folding roller which co-operates with one of the first folding rollers. As a result, a copy sheet fed in the first transport path through the first folding nip and the first transport nip can first be folded between the second folding nip by driving the first transport nip and the first folding nips in the opposite direction and then this sheet once folded can be again folded in the first folding nip by reversing the direction of transport of the first folding nip.

In another attractive embodiment of a device according to the present invention, the first folding nip is situated after the first transport nip as considered in the direction of transport of a copy sheet which is not to be folded. As a result, a copy sheet can first be folded in the middle in the second folding nip, whereupon the trailing half of the copy sheet in the first folding nip can be folded in the middle of said half in a direction opposed to the direction of the first fold, thus forming a Z-folded copy sheet. Another effect is that the folded copy sheet can be fed through the first transport path without delay because the trailing edge of the copy sheet always retains its normal transport speed during folding.

In yet another attractive embodiment of a device according to the invention, the first folding nip is situated in front of the first transport nip as considered in the direction of transport of a copy sheet which is not to be folded, and withdrawable stops are provided in the first transport path on either side of the first transport nip. As a result, a copy sheet can be fed against the first stop as considered in the direction of transport and, while continuing to be fed through the first transport nip, the sheet can be folded first by the second folding nip in the middle of the trailing half, and, after withdrawal of the leading half past the other stop and subsequent activation of said other stop and reversal of the direction of transport of the first and second folding rollers, the copy sheet folded in one direction can be folded in the middle in the first folding nip. Use of the stops gives an accurate position of the folds with respect to the original leading edge of the copy sheet with such positioning only being dependent on the geometry of the device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
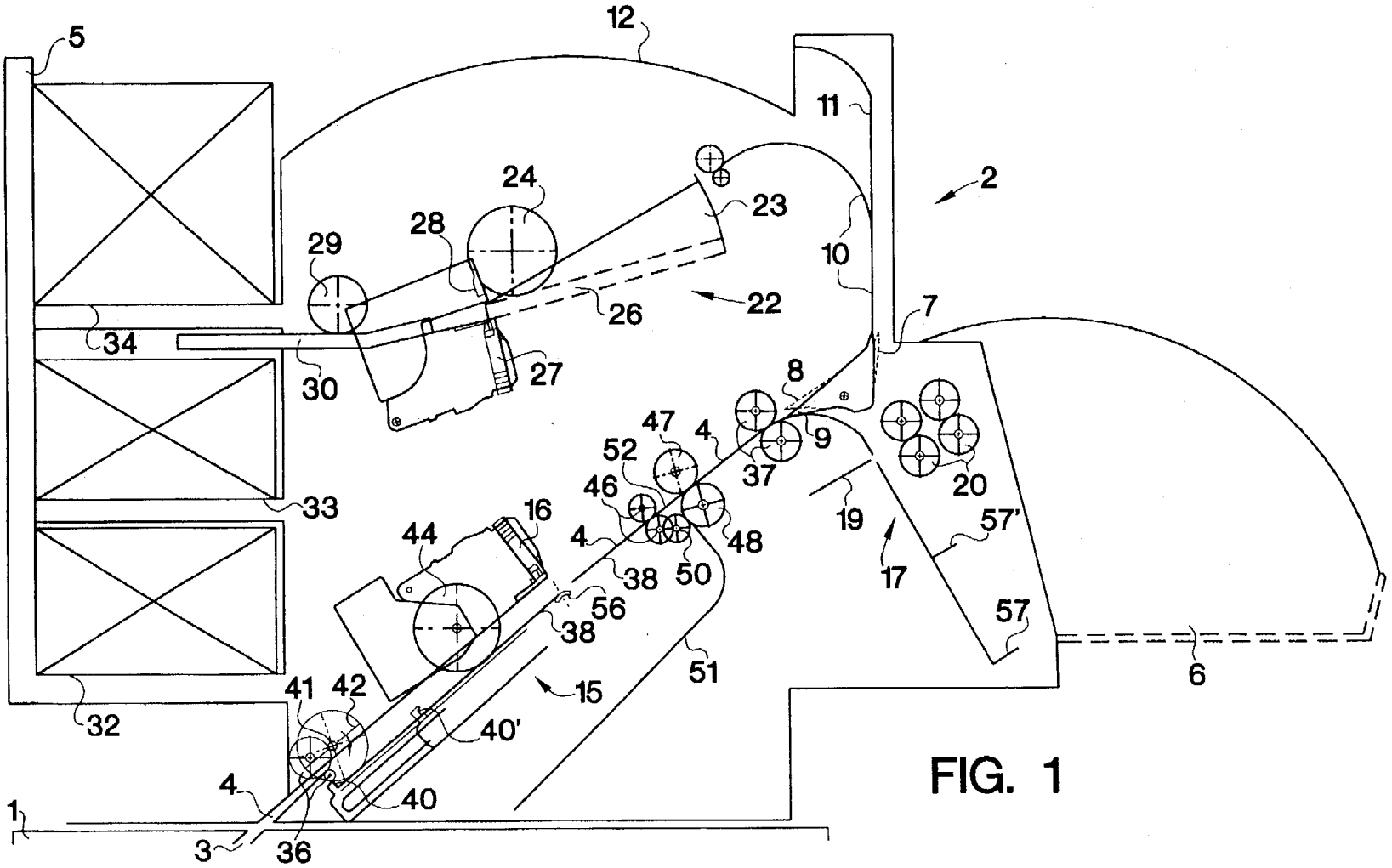
FIG. 1 is a diagram of a first embodiment of a device according to the present invention.

The finishing device 1 shown in FIG. 1 is disposed at the top of the copying machine 2, the latter having an outlet 3 for copy sheets printed in the copying machine. A transport path 4 formed in the finishing device 1 adjoins the outlet 3 and is used for conveying copy sheets from outlet 3 to copy delivery stations 5 and 6 in the finishing device. Delivery station 5 is intended for delivering copy sheets in the form of bundles of copy sheets which may or may not be attached to one another in a marginal zone and folding delivery station 6 is intended for the delivery of copy sheets in the form of bundles of double-folded copy sheets attached to one another at the fold line. A diverter 7 is disposed at the end of the transport path 4 for guiding copy sheets from transport path 4 selectively to delivery station 5 or 6, and in the bottom position shown by lines 9 deflects upwards towards delivery station 5 copy sheets conveyed by the common transport path 4 while in the top position shown by dotted lines 8, it deflects downwardly towards delivery station 6 copy sheets conveyed by the common transport path 4. A branch 11 to a third station 12 is provided in the transport path 10 extending from diverter 7 towards delivery station 5 and by means of a diverter (not shown) is accessible for delivery of copy sheets which do not fit in delivery station 5, e.g. sheet formats differing from the sheet formats that can be delivered to delivery station 5.

In the embodiment shown in the drawings, delivery station 5 is adapted to the delivery of bundles of copy sheets of A4 format and copy sheets of A3 format which are refolded to the A4 format, delivery station 12 is adapted to the delivery of loose copy sheets of all formats between A3 and A5 and delivery station 6 is adapted to the delivery of bundles of double-folded copy sets which have the A4 or A5 format in the double-folded condition. In addition, delivery station 12 is adapted to the delivery of A4 sheets folded into three parts longitudinally for accommodation in an elongated (window) envelope.

The transport path 4 between the outlet 3 from the copying machine 1 and the diverter 7 has an angle of inclination of approximately 40°. The resulting upwardly sloping path contains a collecting station 15 for collecting a number of copy sheets to form a stack, which stack of copy sheets are then attached to one another by a stapling device 16 above the transport path 4, and with diverter 7 in position 8 the stack is fed to folding station 17, where a folding blade 19 so presses the stapled stack of copy sheets between additional folding rollers 20 as to fold the stack into a booklet along the staple line.

A collecting station 22 for collecting into a straight stack copy sheets conveyed successively by transport paths 4 and 10 is provided between the transport path 4 and the delivery station 12 thereabove. Transport path 10 is a concave plate. Collecting station 22 comprises a downwardly sloping collecting tray 23 provided with a withdrawable abutment (not shown) at the lowest tray edge in the downstream direction. Copy sheets fed to the collecting tray 23 are fed against the withdrawable abutment by a transport roller 24 and collected into a bundle shown in broken lines 26, whereupon the collected bundle of copy sheets can be stapled by a stapling device disposed near the lowest tray edge. The stapling device includes a movable stapling head 27 beneath the tray and an anvil 28 above the tray. After stapling, transport means (not shown) and guide roll 29 feed the bundle from the broken-line collecting position 26 to delivery station 5 via a solid-line intermediate position 30.

Delivery station 5 can be constructed as described in European patent 0 532 069, which delivery station consists of a number of delivery tables 32, 33 and 34 independently adjustable as to height. The middle delivery table 33 in the accompanying FIG. 1 is shown with a stack of copy sheets thereon in the delivery station for a bundle of copy sheets 30.

The transport path 4 is in the first instance adapted to feed an A4 or comparable format copy sheet transversely (longest sheet edge as the leading edge) to the collecting station 22. For this purpose, the transport path 4 is provided with a fixed pair of transport rollers 36 at the beginning of said path 4 near the outlet 3 of the copying machine 1 and a fixed pair of transport rollers 37 at the end of said path 4 just in front of the diverter 7. Transport rollers are so disposed at regular intervals between the pairs of rollers 36 and 37 that a transversely fed sheet is always engaged by at least one of the transport rollers. In the case of an A4 sheet, this means a distance of approximately 200 mm maximum.

Between the transport rollers 36 and 37 the transport path 4 is formed by a plate 38 which is inclined at an angle of approximately 40° and which extends from a point situated some distance beneath the pair of transport rollers 36 to the transport nip formed by the pair of transport rollers 37. Thus plate 38 forms a collecting tray for collecting a number of copy sheets to form a straight stack, which number can vary from two sheets to, for example, twenty. The bottom edge of the collecting tray formed by plate 38 is formed by an abutment strip 40 which is adjustable in a direction parallel to the plate 38 between a bottom position in which the abutment strip 40 is situated beneath the pair of transport rollers 36 and a higher position 40'. In the bottom position of abutment strip 40, copy sheets released by the pair of transport rollers 36 drop onto the plate 38 or on copy sheets already thereon. In order to collect copy sheets up to a length of the longest dimension of an A3 format (420 mm) on plate 38 between the transport roller pairs 36 and 37, the transport nips present in the transport path 4 between the pairs of transport rollers 36 and 37 are openable; these transport nips will be described in detail hereinafter. In the collection of copy sheets on plate 38, after being released by the pair of transport rollers 36, the sheets are subject to gravity and are helped by flexible strips 42 rotating in the indicated direction about axis 41 in register with the abutment 40.

After copy sheets have been collected on support 38 of collecting station 15, and when a copy sheet has to be fed as a single sheet through transport path 4, the openable transport nips between the pairs of transport rollers 36 and 37 are closed for further copy sheet transport through and from transport path 4. Considered from the pair of transport rollers 36, the openable transport nips are formed by a roller 44 which presses on the plate 38 at a distance from the pair of transport rollers 36, such distance being less than the smallest dimension of a sheet format to be processed by the device (e.g. the width of an A4 sheet, equal to the length of an A5 sheet). A pair of transport rollers 46 is provided at a corresponding distance past roller 44 and a pair of rollers 47 and 48 at a short distance past the pair of rollers 46, which rollers 47 and 48 serve as folding nip in the manner to be described hereinafter. The transport roller 44, the pair of transport rollers 46 and the folding rollers 47 and 48 form transport nips for transporting copy sheets through the transport part 4 of a minimum width of an A4 format and a maximum length of an A3 format. An A3 sheet supplied in the longitudinal direction can be folded by the folding rollers 47 and 48 (V-fold or Z-fold) into the A4 format and can be fed as an A4 sheet to collecting station 22 or delivery station 12.

To provide a Z-folded A3 sheet, the folding station comprises a third folding roller 50 situated between the pair of transport rollers 46 and the folding roller 48 and forms a folding nip with folding roller 48 in a folding path 51 which forms a branch off the transport path 4 and the direction of rotation of the folding rollers 47, 48 and 50 is reversible. A deflecting element 52 is also disposed in the space between the pair of transport rollers 46 and the folding rollers 47, 48, 50 to deflect to the folding path 51 a copy sheet fed in the transport path 4.

The transport roller 44, the top roller of the pair of transport rollers 46, folding roller 47 and deflecting element 52 can be brought by means not shown from the position shown in FIG. 1 to a short distance above the transport path 4 to create space for the collection of copy sheets in the collecting station 15 formed by plate 38 and abutment 40.

Seen in the direction of sheet transport, a stapling head 16 is disposed above the transport path 4 halfway between the pairs of transport rollers 36 and 37 and can co-operate with an anvil 56 disposed beneath the transport path 4 in order to apply one or two staples to the center of collected copy sheets, which copy sheets are then double folded by folding blade 19 on the stapling line to form a booklet or brochure for delivery in delivery tray 6. In order to staple and double-fold in the middle copy sheets having a shorter length than the length of an A3 sheet, e.g. an A4 sheet, abutment strip 40 is brought into the position 40' after collection but before stapling and an abutment strip 57 for the leading edge past the additional folding rollers 20 is brought into the position 57'.

The operation of the device described hereinbefore will now be explained with reference to the processing of transversely fed A4 copy sheets and longitudinally fed A3, A4 and A5 sheets. These sheets can be printed with the reading direction parallel to the short side (portrait) or with the reading direction parallel to the long side (landscape).

In the case of landscape printing, two pages can be printed next to one another on each side of the sheet to form a booklet consisting of a bundle of double-folded copy sheets. Printing can also be single or double sided. Single-sided printed copy sheets leave the copying machine outlet 3 with the image side facing upwards. The orientation of the images on the copy sheets at the sequence in which the images of a copying job are printed on the copy sheets are adapted to the required finish of the copy sheets belonging to that copying job. On the basis of a copying machine in which the pages of a copying job are stored in an electronic memory, each print sequence and print orientation can readily be achieved by changing the memory read-out.

A description will now be given of the finishing of the following:

A) transversely fed A4 sheets;

B) longitudinally fed A3 sheets folded to a V-fold to form A4;

C) longitudinally fed A4 sheets folded to a V-fold (pamphlet) or a A-fold (letter for inclusion in a window envelope) to form A5 sheets;

D) longitudinally fed A3 sheets folded to a Z-fold to form A4;

E) longitudinally fed A4 sheets folded to a Z-fold for inclusion in a longitudinal envelope;

F) longitudinally fed A3–A5 sheets which are left unfolded;

G) longitudinally fed A3 sheets stapled and folded in bundles to form a booklet; and H) longitudinally fed A4 sheets stapled and folded in bundles to form a booklet.

A) Transversely Fed A4 Sheets

Copy sheets of a set are fed through transport path 4 and collected in collecting tray 26 of station 22. These transversely fed A4 copy sheets are printed in a page sequence such that the first page of the set arrives in collecting tray 26 with the image side down. Copy sets collected in collecting tray 26 are fed set-by-set to delivery station 5. When a set of copies is stapled by stapler 27 in collecting tray 26, the first copy sheets of a following set are buffered in tray 15, roller 44 being lifted, and after stapling of the previous set are fed jointly from tray 15 to tray 26. Thus, copying can continue without loss of production during stapling of a set. The printing sequence of the buffered copy sheets should be reversed to ensure that the last buffered copy sheet is the first page of a set.

B) Longitudinally Fed A3 Sheets Folded to a V-Fold to Form A4

For double-folding of an A3 sheet, deflecting element 52 is initially brought into a position in which it deflects the leading edge of the sheet towards the folding path 51. Coupled folding rollers 47, 48 and 50 in these conditions rotate in a direction in which the folding nip between rollers 48 and 50 functions as a transport nip which feeds the leading half of the A3 sheet to folding path 51. By reversal of the direction of rotation of the folding rollers 47, 48 and 50, the leading half of the sheet is then fed by folding rollers 50 and 48 and the trailing half of the sheet is fed by the pair of transport rollers 46 towards the nip between the folding rollers 47 and 48 in order to fold the A3 sheet in the latter nip and feed it on as a folded selectively sheet to one of the delivery stations 12 or 5.

Delivery in delivery station 5 is appropriate if the double-folded A3 sheet is included in a set of A4 sheets (combination with the stapling of such a set in the top left-hand corner is not appropriate because of the closed back of the double-folded A3 sheet). Delivery in delivery station 12 is appropriate if the A3 sheet is printed as a one-page booklet with four A4 pages.

C) Longitudinally Fed A4 Sheets Folded to a V-Fold (pamphlet) or a A-fold (Letter for Inclusion in a Window Envelope) to Form AS Sheets To double-fold an A4 sheet, deflector element 52 is, as in the case of B) described above, initially brought into a position in which it deflects the leading edge of the sheet towards folding path 51, whereupon reversal of the direction of rotation of the coupled folding rollers in good time causes the sheet to be double-folded between folding rollers 47 and 48 and delivered in delivery station 12. In the case of single-sided printing of a single double-folded A4 sheet, with the conventional feed of the copy sheet with the image upwards, the image comes on the outside of the double-folded A4 sheet and is thus suitable for despatch as a letter in a (window) envelope of A5 format for the purpose of direct readability of the letter (or the address through the window).

If a folded A4 sheet is sent without an envelope, then printing on the inside is desirable. This can be achieved by reversal of the sheet in the copying machine so that the sheet is fed in transport path 4 with the image facing downwards.

D) Longitudinally Fed A3 Sheets Folded to a Z-Fold to Form A4

For the Z-folding of a longitudinally fed copy sheet, diverter 7 is brought into the bottom position 9 and the copy sheet is transported by the pair of transport rollers 46 and the folding rollers 47 and 48 until the middle of the copy sheet arrives between the pair of transport rollers 46 and the folding rollers 47 and 48. The direction of rotation of the folding rollers 47 an 48 and hence of folding roller 50 is then reversed, the deflecting element 52 which presses lightly on the copy sheet pressing a downwardly directed bulge in the copy sheet, this bulge then being engaged in the nip between folding rollers 48 and 50 to form a fold in the middle of the copy sheet. After approximately half of the trailing half of the copy sheet has been fed in the folding path 51, the direction of rotation of the folding rollers 48, 50 and 47 is again reversed, a bulge again being formed in the space between the rollers 46, 47, 48 and 50, such bulge then being engaged in the nip between the folding rollers 47 and 48 to form a fold in the middle of the trailing half of the copy sheet. The copy sheet thus Z-folded is then fed in the collecting tray 23, if required for stapling with other Z-folded A3 copy sheets and/or unfolded A4 copy sheets, and is delivered as a bundle in delivery station 5. Since the trailing edge of the Z-folded sheet continuously advances through transport path 4, a folded copy sheet can be fed to collecting station 22 without any loss of time in a device according to the invention.

E) Longitudinally Fed A4 Sheets Folded to a Z-Fold for Inclusion in a Longitudinal Envelope For the Z-folding of a longitudinally fed A4 copy sheet, the same cycle as described above of reversing the direction of rotation of the folding rollers 47, 48 an 50 is followed. The reversal of the direction of rotation takes place only if about one-third of the copy sheet has been fed past the pair of transport rollers 46 and then if still approximately one-third of the copy sheet has to be fed past the pair of transport rollers 46. If the copy sheet is a letter with the letterhead on the trailing edge part of the copy sheet, the copy thus folded can be fed as a Z-folded letter in delivery station 12 ready for dispatch in an elongated window envelope.

F) Longitudinally Fed A3–A5 Sheets Which Are Left Unfolded

Copy sheets of A3 and A5 format which cannot be collected in collecting tray 22 are longitudinally fed sheets and are fed via transport path 4 directly to delivery tray 12. This also applies to longitudinally fed copy sheets of intermediate formats.

G) Longitudinally Fed A3 Sheets Stapled and Folded in Bundles to Form a Booklet

To fold a booklet consisting of a number of double-folded A3 format copy sheets stapled on the fold line, the transport roller 44, top transport roller 46 and folding roller 47, together with the deflecting element 52, are lifted sufficiently to stack these sheets on plate 38 without obstruction. Abutment strip 40 in these conditions is in the position denoted by 40. Copy sheets for collection are brought in to register against this abutment 40 by rotating flaps 42.

After the collecting stage, with the front and back pages at the top of the topmost sheet, stapling heads 16 press one or two staples into the middle of the bundle of copy sheets, whereafter transport rollers in the transport path 4 transport the bundle, with diverter 7 in the top position 8, against abutment 57. A folding blade 19 then presses the bundle on the stapling line by the additional folding rollers 20 and the finished booklet arrives in the delivery tray 6.

H) Longitudinally Fed A4 Sheets Stapled and Folded in Bundles to Form a Booklet

The folding of a booklet from a number of double-folded copy sheets of A4 format differs from the procedure above-described under G) inasmuch as after the collection of the copy sheets for stapling in the middle the abutment strip brings the same from the collecting position 40 to the stapling position 40' in order to bring the middle of the bundle beneath the stapling head or heads 16 and abutment strip 57 is put into the position 57' in order to bring the stapling line directly opposite the folding blade 19.

Figure 3:
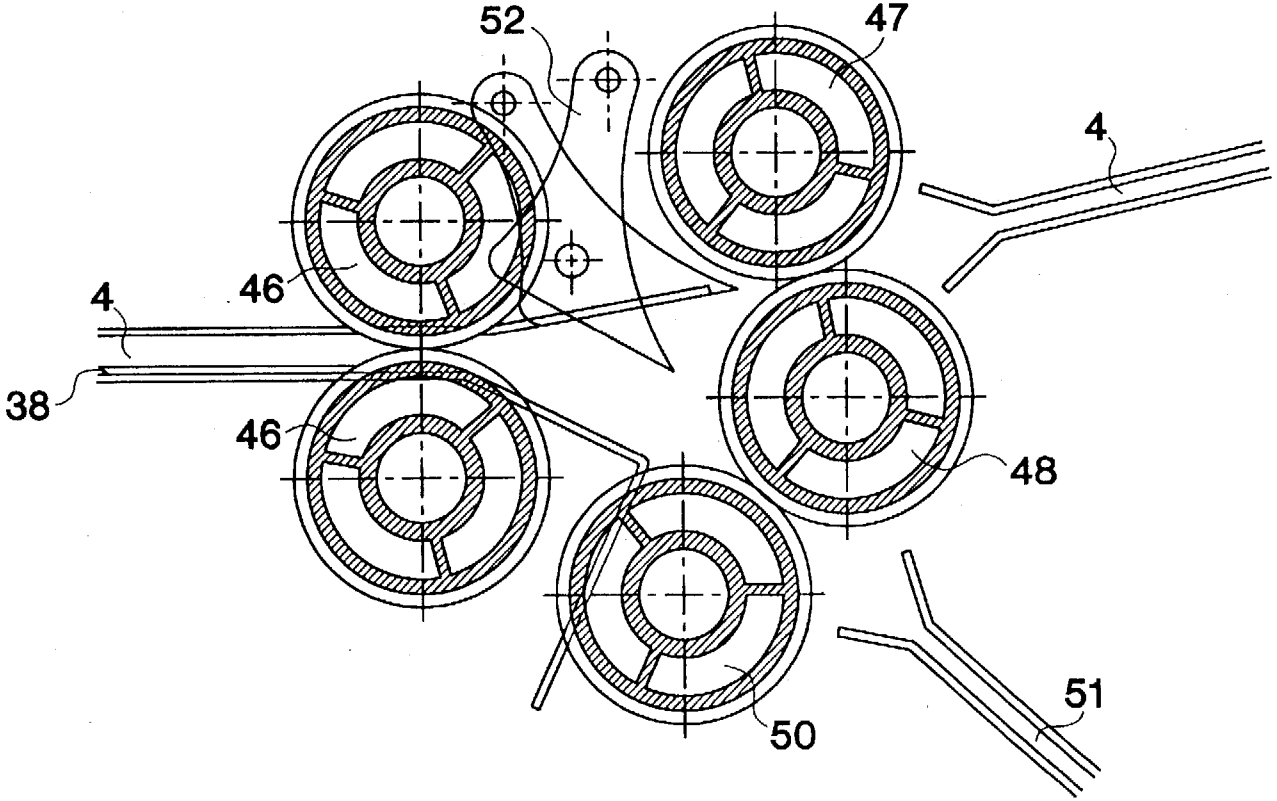
FIG. 3 is a constructional embodiment of a folding device used in the first embodiment.

FIG. 3 show a constructional embodiment of the folding device shown in FIG. 1 for V-folding and Z-folding of copy sheets fed longitudinally through the transport path 4. The folding rollers 47, 48 and 50 and the pair of transport rollers 46 used therein have the same diameters. In the zone between the pair of transport rollers 46 and folding rollers 47 and 48, the transport path 4 has a small bend to ensure that a part of a sheet situated between the pair of transport rollers 46 and folding rollers 47, 48 on reversal of the folding rollers 47 and 48 bulges downwards for folding the copy sheet between the folding rollers 48 and 50. In these conditions, the deflecting element 52 is in a top position in which element 52 is situated completely outside the transport path 4. For the V-folding of a copy sheet between folding rollers 47 and 48 the deflecting element 52 is brought into the bottom position shown in FIG. 3, in which the deflecting element 52 projects into the transport path 4 in order to deflect towards the folding path 51 the leading edge of a copy sheet fed by the pair of transport rollers 46.

Figure 2:
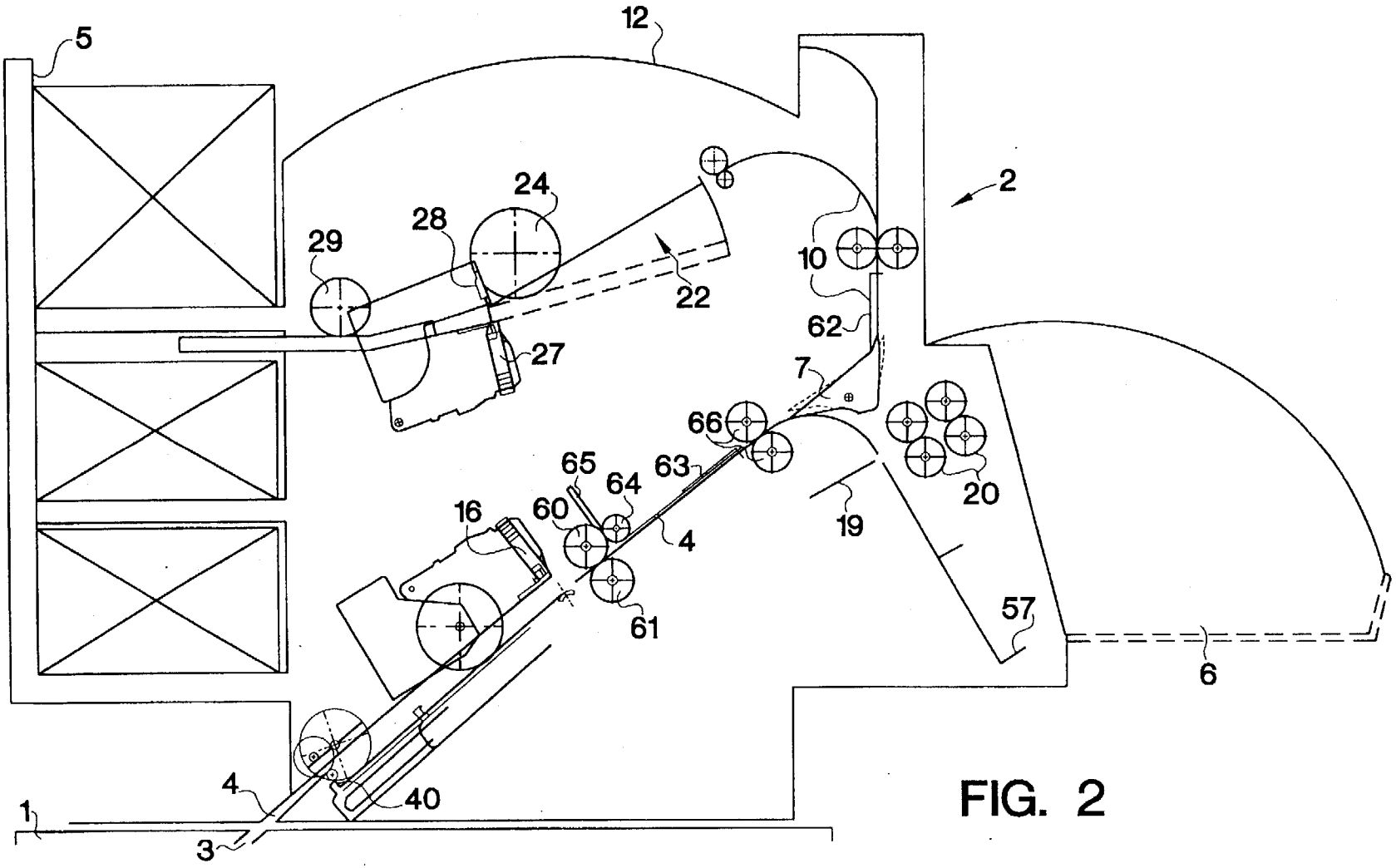
FIG. 2 is a diagram of a second embodiment of a device according to the present invention.

FIG. 2 shows an embodiment of a device according to the invention which differs from the device shown in FIG. 1 only in respect of the Z-folder. Only the parts belonging to the Z-folder are therefore described below. Corresponding parts of the devices shown in FIGS. 1 and 2 are denoted by the same references. The Z-folder shown in FIG. 2 comprises folding rollers 60 and 61 which directly behind the stapling device 16 form a folding nip in the transport path 4. For the Z-folding of an A3 copy sheet, withdrawable abutments 62 and 63 are disposed in the transport paths 10 and 4 and are situated respectively at distances of ¾ and ½ sheet length from the transport and folding nip formed by folding rollers 60 and 61. For the Z-folding of formats differing from A3 formats, the abutments 62 and 63 are adjustable in the direction of sheet transport.

On the side of the top folding roller 60 facing abutments 62 and 63 a folding roller 64 forms a folding nip with folding rollers 60, such nip being situated in a folding path 65 forming a branch of the transport path 4. The coupled folding rollers 60, 61 and 64 are adapted to be driven in two directions of rotation. A pair of transport rollers 66 is disposed in the transport path 4 between the abutments 62 and 63.

The operation of the Z-folder shown in FIG. 2 will now be described. An A3 copy sheet is fed through the transport nips in transport path 4 formed by rollers 60 and 61 and rollers 66, towards abutment 62, diverter 7 of course being in its bottom position 9. With a closed construction of the transport paths 4 and 10, after the copy sheet front edge has come into contact with abutment 62 during its movement, a bulge can form only in the space in front of the folding rollers 60 and 64 and is then folded in the nip therebetween at a distance of ¾ of the sheet length after the front edge. Since the folding position is determined by the distance between the folding rollers and the abutment 62, the folding position is accurately fixed and is independent of the timing of the reversal of the transport direction as is the case in the folding device shown in FIG. 1.

After the original leading sheet edge has been withdrawn to past abutment 63 and the trailing sheet edge has been withdrawn from the nip between rollers 60 and 61, the direction of rotation of the folding rollers 60, 61 and 64 is reversed so that the transport nip between folding rollers 60 and 64 press the leading edge against the abutment 63 activated in the meantime. The sheet will then bulge in the space beyond the folding rollers 60 and 61, which are now rotating in a reverse direction, and the sheet will be folded in the nip between folding rollers 60, 61 at a distance of ½ sheet length after the front edge. As soon as the sheet has been completely fed from the nip between the folding rollers 60 and 64, the direction of rotation thereof is again reversed and the folding rollers 60 and 61 feed the Z-folded copy sheet along the abutments 62 and 63, which have been withdrawn in the meantime, to the collecting station 22.

In contrast with the devices shown in the drawings, the folding path 51 and the folding roller 50 according to FIG. 1 may also be situated at the top of the transport path 4 and the folding path 65 and the folding roller 64 according to FIG. 2 can be situated at the bottom of the transport path 4. In that case, the Z-folded copy sheet is fed with the folds in the leading part of the copy sheet via transport path 10 to the collecting station 22, where it is straightened against an abutment (not shown) by its leading edge. The stapler device 27, 28 is in these conditions disposed on the side of the collecting tray 23 situated upstream. The advantage of this variant is that the copy sheets collected in this way are aligned against the abutment at their unbound side edge so that the free sheet edges come to lie exactly straight one above the other, and this facilitates leafing through. One consequence is that the images must be imaged on copy sheets turned about 180°, but in a digital copying machine this can easily be achieved by 180° rotation of the image data during the image processing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A device for collecting copy sheets into a stack, at least one sheet in the stack being foldable with length and width dimensions when folded which are at maximum equal to length and width dimensions of unfolded copy sheets in the stack, the device comprising:

a collecting station for holding the stack of copy sheets;

a first transport path for feeding copy sheets to the collecting station;

at least one pair of first folding rollers forming a first folding nip, the first folding nip being situated in the first transport path;

a first transport nip in the first transport path for transporting a copy sheet to the first folding nip;

a second transport path adjacent a side of one of the first folding rollers, the second transport path facing the first transport nip and extending as far as the first transport path; and a second transport nip in the second transport path, a direction of transport of the second transport nip being reversible.

2. The device according to claim 1, wherein the first folding rollers are rotatable in reversible directions and wherein the second transport nip is a second folding nip which is formed by a second folding roller which co-operates with the one first folding roller which is adjacent the second transport path.

3. The device according to claim 2, wherein the first folding nip is situated after the first transport nip in a transport direction of a copy sheet which is not to be folded.

4. The device according to claim 2, wherein the transport path is bent between the first transport nip and the first folding nip in a direction of the second transport path.

5. The device according to claim 2, wherein the first folding nip is situated in front of the first transport nip in a transport direction of a copy sheet which is not to be folded, and wherein the device further comprises withdrawable stops provided in the first transport path on either side of the first transport nip.

6. The device according to claim 2, wherein the first folding nip and the first transport nip are openable and wherein the device further comprises a stapling device for stapling copy sheets collected between the opened nips, the stapling device being provided in front of the first folding nip in a transport direction of a copy sheet and being in a zone generally in the middle of the collected sheets.

7. The device according to claim 1, wherein the first folding nip is situated after the first transport nip in a transport direction of a copy sheet which is not to be folded.

8. The device according to claim 7, wherein the transport path is bent between the first transport nip and the first folding nip in a direction of the second transport path.

9. The device according to claim 1, wherein the transport path is bent between the first transport nip and the first folding nip in a direction of the second transport path.

10. The device according to claim 1, wherein the first folding nip is situated in front of the first transport nip in a transport direction of a copy sheet which is not to be folded, and wherein the device further comprises withdrawable stops provided in the first transport path on either side of the first transport nip.

11. The device according to claim 1, wherein the first folding nip and the first transport nip are openable and wherein the device further comprises a stapling device for stapling copy sheets collected between the opened nips, the stapling device being provided in front of the first folding nip in a transport direction of a copy sheet and being in a zone generally in the middle of the collected sheets.

12. The device according to claim 11, wherein the first transport nip comprises a pair of rollers which are movable away from one another during opening of the transport nip and wherein one roller of the at least pair of first folding rollers is movable away from another roller in the pair of folding rollers during opening of the transport nip.

13. The device according to claim 1, further comprising means adjacent the second transport path for urging a portion of a copy sheet toward the second transport path, the portion of the copy sheet urged being a portion between ends of the copy sheet.

14. The device according to claim 1, further comprising a folding station with a folding blade and additional folding rollers, the folding station being downstream of the transport path, at least one copy sheet being receivable in the folding station from the transport path and thereafter being folded by the folding blade and additional folding rollers, the device further comprises a diverter for directing the at least one copy sheet from the transport path to the folding station.

15. A method for collecting copy sheets into a stack, at least one sheet in the stack being foldable with length and width dimensions when folded which are at maximum equal to length and width dimensions of unfolded copy sheets in the stack, the method comprising the steps of:

feeding copy sheets through a first transport path in a transport direction;

providing a first folding nip in the first transport path, the first folding nip being formed by at least one pair of first folding rollers;

providing a first transport nip in the first transport path for transporting a copy sheet to the first folding nip;

selectively feeding the copy sheets to a second transport path when the sheets are to be folded, the second transport path being adjacent a side of one of the first folding rollers and facing the first transport nip, the second transport path extending as far as the first transport path;

providing a second transport nip in the second transport path, a direction of transport of the second transport nip being reversible; and discharging the copy sheets from the first transport to a collecting station for holding the stack of copy sheets.

16. The method according to claim 15, wherein the first folding rollers are rotatable in reversible directions and wherein the second transport nip is a second folding nip which is formed by a second folding roller which co-operates with the one first folding roller which is adjacent the second transport path, the method further comprising the step of reversing a direction of rotation of the first folding rollers when a copy sheet is to be fed to the second transport path.

17. The method according to claim 15, wherein the first folding nip is situated downstream of the first transport nip and wherein the first transport nip comprises a pair of rollers, the method further comprises the step of rotating the pair of rollers of the first transport nip to move a copy sheet therebetween.

18. The method according to claim 15, wherein the first folding nip is situated upstream of the first transport nip, and wherein the method further comprises the steps of:

providing withdrawable stops in the first transport path; and inserting and withdrawing the stops into and from the first transport path when a copy sheet is to be folded.

19. The method according to claim 15, further comprising the steps of:

opening the first folding nip and the first transport nip;

stapling copy sheets collected between the first folding nip and the first transport nip when the nips are opened, the copy sheets being stapled generally in the middle thereof.

20. The method according to claim 17, wherein the second transport nip includes at least one rotatable roller and wherein the method further comprises the steps of:

deflecting a leading edge of a copy sheet towards the second transport path;

feeding a leading half of the copy sheet to the second transport path by rotating rollers of the first folding nip and the second transport nip in a predetermined direction of rotation;

reversing a direction of rotation of the rollers of the first folding nip and the second transport nip from the predetermined direction of rotation;

simultaneously feeding the leading half and a trailing half of the copy sheet toward the first folding nip upon reversing of the direction of rotation of the rollers; and folding the copy sheet in a mid-section as the copy sheet moves through the first folding nip during the step of simultaneously feeding.

21. The method according to claim 17, wherein the first transport nip includes a pair of rotatable rollers and wherein the method further comprises the steps of:

transporting the copy sheet between the pair of rotatable rollers of the first transport nip and the first folding nip;

reversing a direction of rotation of the first folding rollers after about half of the copy sheets have been transported through the first transport nip;

pressing a deflecting element on a portion of the copy sheet between the first transport nip and the first folding nip to urge the portion of the copy sheet toward the second transport path;

engaging the portion of the copy sheet pressed by the deflecting element in the second transport nip to thereby form a fold generally in a middle of the copy sheet;

again reversing a direction of rotation of the first folding rollers after about half of a trailing half of the copy sheet is fed to the second transport path;

forming a bulge in the copy sheet in a space between the first transport nip and the first folding nip after the step of again reversing the direction of rotation;

engaging the bulge of the copy sheet in the first folding rollers to form a fold generally in a middle of the trailing half of the copy sheet; and feeding the copy sheet which has been twice folded to the collecting station.

22. The method according to claim 15, wherein the first transport nip includes a pair of rotatable rollers and wherein the method further comprises the steps of:

transporting the copy sheet between the pair of rotatable rollers of the first transport nip and the first folding rollers;

reversing a direction of rotation of the first folding rollers after about one third of the copy sheet has been transported through the first transport nip;

pressing a deflecting element on a portion of the copy sheet between the first transport nip and the first folding nip to urge the portion of the copy sheet toward the second transport path;

engaging the portion of the copy sheet pressed by the deflecting element in the second transport nip to thereby form a fold generally in an upper third of the copy sheet;

again reversing a direction of rotation of the first folding rollers when about a third of the copy sheet remains to be fed between the first transport nip;

forming a bulge in the copy sheet in a space between the first transport nip and the first folding nip after the step of again reversing the direction of rotation;

engaging the bulge of the copy sheet in the first folding rollers to form a fold generally in the trailing half of the copy sheet; and feeding the copy sheet which has been twice folded to the collecting station.

* * * * *